US010667349B2

(12) United States Patent
Lu

(10) Patent No.: US 10,667,349 B2
(45) Date of Patent: May 26, 2020

(54) ALTERNATING CURRENT (AC) DIMMING AND EMERGENCY POWER SUPPLY METHOD AND DEVICE

(71) Applicant: Dongcheng Lu, Guangdong (CN)

(72) Inventor: Dongcheng Lu, Guangdong (CN)

( * ) Notice: Subject to any disclaimer, the term of this patent is extended or adjusted under 35 U.S.C. 154(b) by 0 days.

(21) Appl. No.: 15/227,185

(22) Filed: Aug. 3, 2016

(65) Prior Publication Data

US 2020/0107416 A1 Apr. 2, 2020

(51) Int. Cl.

| | |
|---|---|
| ***H05B 45/10*** | (2020.01) |
| ***F21S 9/02*** | (2006.01) |
| ***H05B 39/04*** | (2006.01) |

(52) U.S. Cl.

CPC ..... *H05B 45/10* (2020.01); *F21S 9/022* (2013.01); *H05B 39/047* (2013.01)

(58) Field of Classification Search

CPC ..... H05B 45/10; H05B 39/047; F21S 9/022
See application file for complete search history.

(56) References Cited

U.S. PATENT DOCUMENTS

| | | | | |
|---|---|---|---|---|
| 5,656,925 | A * | 8/1997 | Schie | H02J 9/061 323/222 |
| 5,661,645 | A * | 8/1997 | Hochstein | H02J 9/065 363/89 |
| 9,980,337 | B1 * | 5/2018 | Coombes | H05B 45/20 |
| 2013/0257276 | A1 * | 10/2013 | Asato | H05B 45/50 315/88 |
| 2014/0312699 | A1 * | 10/2014 | Wang | H02J 7/0068 307/66 |

* cited by examiner

*Primary Examiner* — Evan P Dzierzynski
(74) *Attorney, Agent, or Firm* — Rosenberg, Klein & Lee

(57) ABSTRACT

The invention discloses an Alternating Current (AC) dimming and emergency power supply method. When there is commercial power, a Pulse Width Modulation (PWM) pulse module controls a relay to switch off dimming AC output by a dual-operational amplification module and an AC signal sent by a central processor module, and at this moment, AC of the commercial power supplies power to a Light-Emitting Diode (LED) illumination module through an LED driving module and simultaneously charges a storage battery through a voltage stabilization charging module; and when there is no commercial power input, the central processor module outputs and transmits a positive power signal to the relay through the dual-operational amplification module, and the relay connects the dimming AC output by the dual-operational amplification module with the AC signal sent by the central processor module, and transmits the positive power signal to the AC.

7 Claims, 12 Drawing Sheets

ALTERNATING CURRENT (AC) DIMMING AND EMERGENCY POWER SUPPLY METHOD AND DEVICE

FIELD OF THE INVENTION

The invention relates to the field of emergency illumination, and in particular to an AC dimming and emergency power supply method and a device for implementing the method.

BACKGROUND OF THE INVENTION

A voltage of commercial power may usually get instable to make illumination equipment flicker in daily life, which may easily cause damage to an illumination load and shorten service life of the illumination load; and in addition, timely illumination may not be ensured under the condition of power supply interruption caused by bad weather or a line failure.

SUMMARY OF THE INVENTION

For the shortcomings of a conventional art, the invention is intended to provide an AC dimming and emergency power supply method and a device for implementing the method, which solve the problems that only direct current may be output by emergency power supply and that luminance of a load may not be intelligently regulated in the conventional art.

The technical solutions adopted to achieve the purpose of the invention are implemented as follows.

An AC dimming and emergency power supply method is provided, which includes the following steps that:

(1) a Pulse Width Modulation (PWM) pulse module is arranged, an input end of the PWM pulse module being connected with AC of commercial power;

(2) a relay is arranged at an output end of the PWM pulse module, and the relay is also connected with the commercial power;

(3) a Light-Emitting Diode (LED) illumination module is arranged, an LED driving module being connected between the LED illumination module and the commercial power;

(4) a storage battery module is arranged, the storage battery module including a power stabilization charging module and a storage battery;

(5) a dual-operational amplification module and central processor module which are connected with each other are arranged, the storage battery being connected with the central processor module and supplying power to the central processor module for long;

(6) an emergency illumination LED module connected with the central processor module is arranged;

(7) when there is commercial power, the PWM pulse module controls the relay to switch off dimming AC output by the dual-operational amplification module and an AC signal sent by the central processor module, and at this moment, the AC of the commercial power supplies power to the LED illumination module through the LED driving module and simultaneously charges the storage battery through the voltage stabilization charging module; and (8) when there is no commercial power input, the central processor module outputs and transmits a positive power signal to the relay through the dual-operational amplification module, the relay connects the dimming AC output by the dual-operational amplification module with the AC signal sent by the central processor module, and transmits the positive power signal to the AC, thereby supplying power to a load connected to the AC to implement emergency power supply, and at the same time of emergency power supply, LED AC dimming is implemented through the dual-operational amplification module and the central processor module.

The PWM pulse module includes a chip IC2, a resistor R9, a resistor R16, an inductor L3, a resistor R21, a bridge rectifier D10, a capacitor C9, a capacitor C11, a capacitor C10, a diode D12 and a diode D11, wherein pin 1 of the chip IC2 is connected with pin 2 of the chip IC2, a positive electrode of the diode D11 and one end of the capacitor C10, pin 4 of the chip IC2 is connected with the other end of the capacitor C10, a negative electrode of the diode D12, one end of the inductor L3 and one end of the resistor R16, pin 5 of the chip IC2 is connected with pin 6 of the chip IC2, one end of the resistor R9, pin 4 of the bridge rectifier D10 and a positive electrode of the capacitor C9, the other end of the resistor R9 is connected with the other end of the resistor R16, a negative electrode of the diode D11 is connected with the relay, a negative electrode of the capacitor C11, a negative electrode of the capacitor C9 and pin 1 of the bridge rectifier D10, a positive electrode of the diode D12 is connected with a positive electrode of the capacitor C11, the other end of the inductor L3 and one end of the resistor R12, the other end of the resistor R12 is connected with the relay, and pins 2 and 3 of the bridge rectifier D10 are connected with the commercial power.

The LED driving module includes a resistor R1, an inductor L1, a capacitor C1, a bridge rectifier D1, a resistor R2, an inductor L2, a resistor R3, a capacitor C2, a capacitor C3, a resistor R4, a resistor R10, a capacitor C4, a resistor R8, a diode D2, a transformer T1, a resistor R11, a diode D3, a diode D4, a chip IC1, a resistor R14, a capacitor C6, a capacitor C7, a diode D5, a resistor R12, a resistor R7, a resistor R13, a capacitor C5, a Metal Oxide Semiconductor (MOS) tube Q1, a resistor R6, a resistor R5, a diode D6, a capacitor C8 and a resistor R15, wherein one end of the resistor R1 and one end of the inductor L1 are connected with the commercial power, the other end of the resistor R1 is connected with the other end of the inductor L1, one end of the capacitor C1 and pin 3 of the bridge rectifier, and pin 2 of the bridge rectifier D1 and the other end of the capacitor C1 are connected with the relay; and pin 4 of the bridge rectifier is connected with one end of the resistor R2 and one end of the inductor L2, the other end of the resistor R2 is connected with the other end of the inductor L2, one end of the resistor R3, one end of the capacitor C3, one end of the resistor R4, one end of the resistor R10, one end of the capacitor C4 and pin 1 of the transformer T1, pin 1 of the bridge rectifier, one end of the capacitor C2 and the other end of the capacitor C3 are all grounded, the other end of the resistor R3 is connected with the other end of the capacitor C2, the other end of the resistor R10 is connected with the other end of the capacitor C4 and one end of the resistor R8, the other end of the resistor R8 is connected with a negative electrode of the diode D2, a positive electrode of the diode D2 is connected with pin 2 of the transformer T1 and electrode D of the MOS tube Q1, pin 1 of the chip IC1 is connected with one end of the resistor R4, pin 4 of the chip IC1 is connected with a negative electrode of the diode D5, one end of the capacitor C7, a positive electrode of the capacitor C6 and one end of the resistor R14, the other end of the resistor R14 is connected with a negative electrode of the diode D4, a positive electrode of the diode D4 is connected with a positive electrode of the diode D3, one end of the resistor R11 and pin 4 of the transformer T1, pin 5 of the chip IC1 is connected with a positive electrode of the diode D5 and one end of the resistor R12, the other end of the resistor R12 is connected with a negative electrode of the diode D5, pin 6 of the chip IC1 is connected with one end of the resistor R13, the other end of the resistor R11 and one end of the capacitor C5, pin 7 of the chip IC1 is connected with electrode S of the MOS tube Q1, one end of the resistor R6 and one end of the resistor R5, pin 8 of the chip IC1 is connected with one end of the resistor R7, the other end of the resistor R7 is connected with electrode G of the MOS tube Q1, the other end of the resistor R13, the other end of the capacitor C5, the other end of the resistor R6, the other end of the resistor R5, pin 5 of the transformer T1, a negative electrode of the capacitor C6 and the other end of the capacitor C7 are all grounded, pin 8 of the transformer T1 is connected with a positive electrode of the diode D6, a negative electrode of the diode D6 is connected with a positive electrode of the capacitor C8, one end of the resistor R15 and an LED load, and pin 7 of the transformer T1, a negative electrode of the capacitor C8 and the other end of the resistor R15 are all grounded.

The dual-operational amplification module includes an inductor L5, a resistor R22, a capacitor C13, a capacitor C14, a capacitor C15, a diode D13, a resistor R33, a resistor R31, a resistor R26, a chip 104, a resistor R32 and a resistor R25, wherein one end of the inductor L5 is connected with the relay, the other end of the inductor L5 is connected with one end of the resistor R22, the other end of the resistor R22 is connected with one end of the capacitor C13 and one end of the capacitor C14, the other end of the capacitor C13 is connected with one end of the capacitor C15, a positive electrode of the diode D13, pin 3 of the chip 104, one end of the resistor R32 and one end of the resistor R25, pin 1 of the chip 104 is connected with the central processor module, pin 2 of the chip 104 is connected with one end of the resistor R33 and one end of the resistor R31, pin 8 of the chip 104 is connected with one end of the resistor R26, the other end of the resistor R26 is connected with the other end of the resistor R31 and the other end of the resistor R32, and the other end of the resistor 33, the other end of the resistor R25 and pin 4 of the chip 104 are all grounded.

The central processor module includes a chip 105, a resistor R34, a resistor R26, a resistor R30, a capacitor C18, a resistor R27 and a resistor R19, wherein pin 1 of the chip 105 is connected with one end of the resistor R27 and one end of the capacitor C18, pin 3 of the chip 105 is connected with one end of the resistor R34, pin 4 of the chip 105 is connected with one end of the resistor R29 and one end of the resistor R30, pin 5 of the chip 105 is connected with the relay, pin 6 of the chip 105 is connected with one end of the resistor R19, and pin 8 of the chip 105, the other end of the resistor R30 and the other end of the capacitor C18 are all grounded.

The emergency illumination LED module includes a triode amplification circuit, an MOS tube amplification circuit and an emergency LED lamp load.

A device for implementing the abovementioned AC dimming and emergency power supply method is provided, which includes a PWM pulse circuit, an input end of the PWM pulse circuit being connected with AC of commercial power, an output end of the PWM pulse circuit being connected with a relay and the relay being also connected with the commercial power; an LED illumination circuit, an LED driving circuit being connected between the LED illumination circuit and the commercial power; a storage battery circuit, the storage battery circuit including a voltage stabilization charging circuit and a storage battery; and the device further including a dual-operational amplification circuit and central processor circuit which are connected with each other, the storage battery being connected with the central processor circuit and supplying power to the central processor circuit, and the central processor circuit being also connected with an emergency illumination LED circuit.

The chip 101 is an LED driving chip 88EM8187, the chip 102 is a PWM switching control chip AH866X, the chip 103 is a charging circuit Itc4054, the chip 104 is a dual-operational amplifier LM358, and the chip 105 is a central processor FMD60F011.

The method and the device have the beneficial effects that: the PWM pulse circuit is arranged, so that an LED luminance regulation function may be realized during supply of the AC, the storage battery and the central processor and dual-operational processor connected with the storage battery are arranged for emergency power supply, and moreover, an LED bulb may be controlled at any time by a switch; and the circuit may be controlled by an ON/OFF switch and a silicon-controlled switch during outage of the commercial power.

DETAILED DESCRIPTION OF THE PREFERRED EMBODIMENTS

Figure 1:
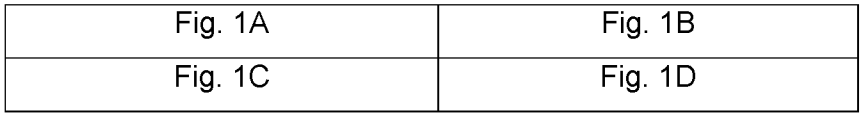
FIG. 1 shows a map of the FIGS. 1A-1D which form an entire schematic.
Figure 1A:
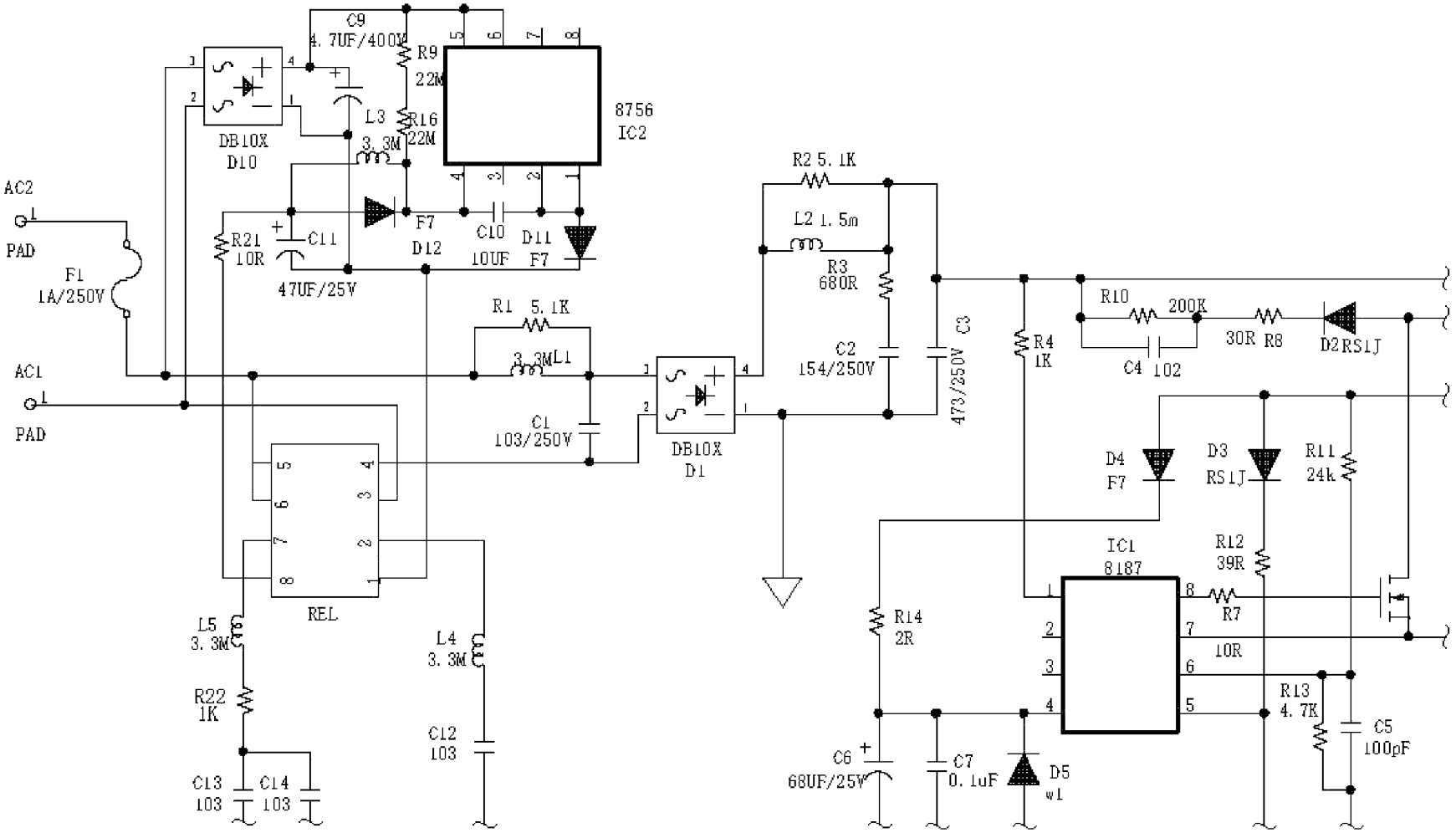
FIGS. 1A-1D are divided structure diagrams of the present invention.
Figure 1B:
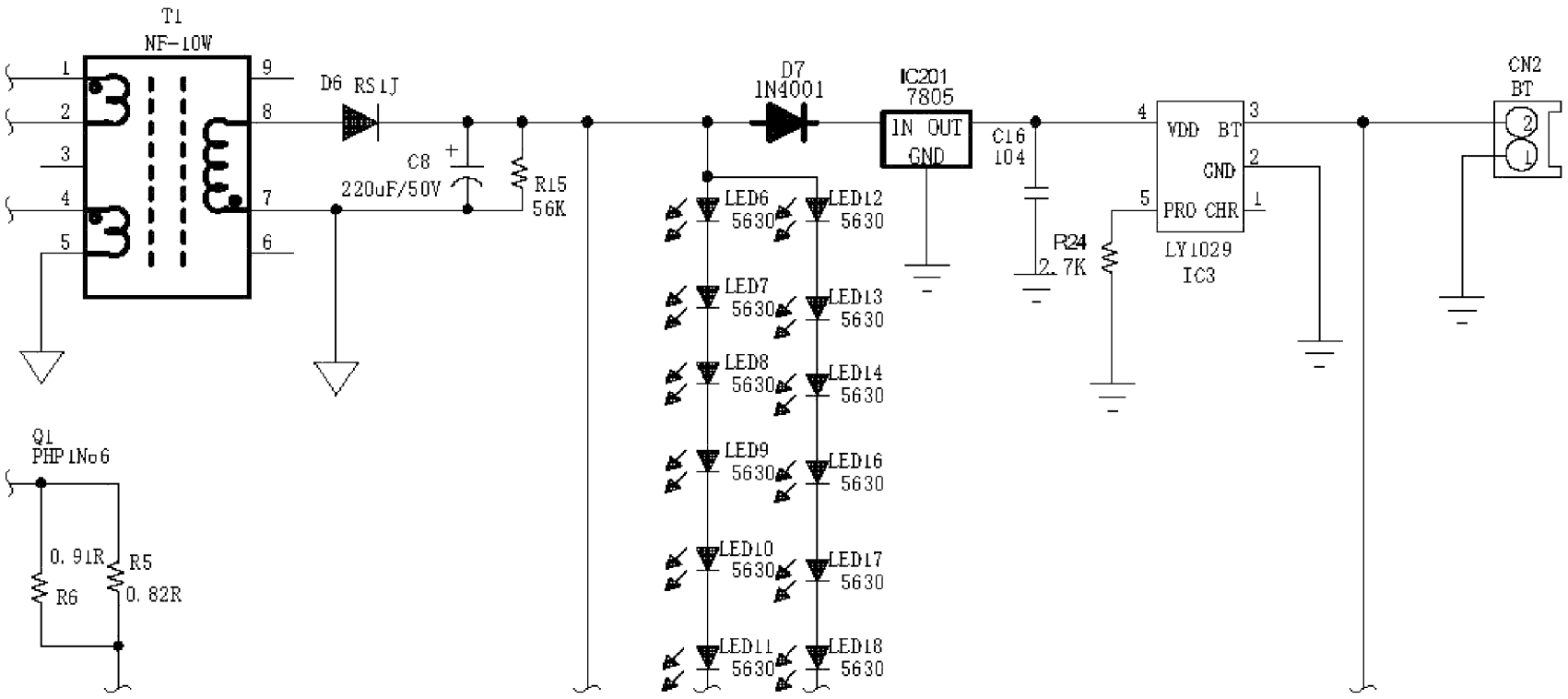
Figure 1C:
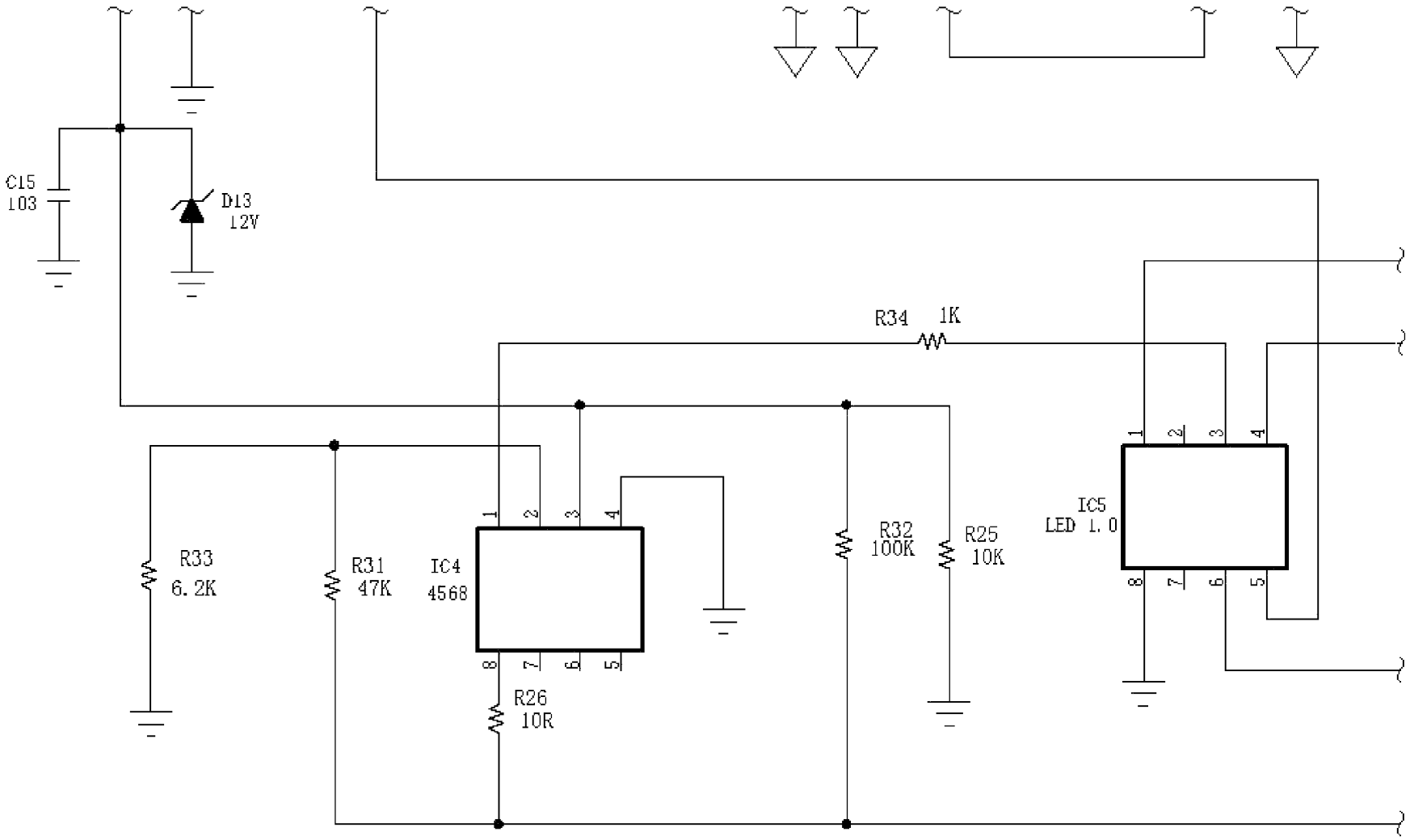
Figure 1D:
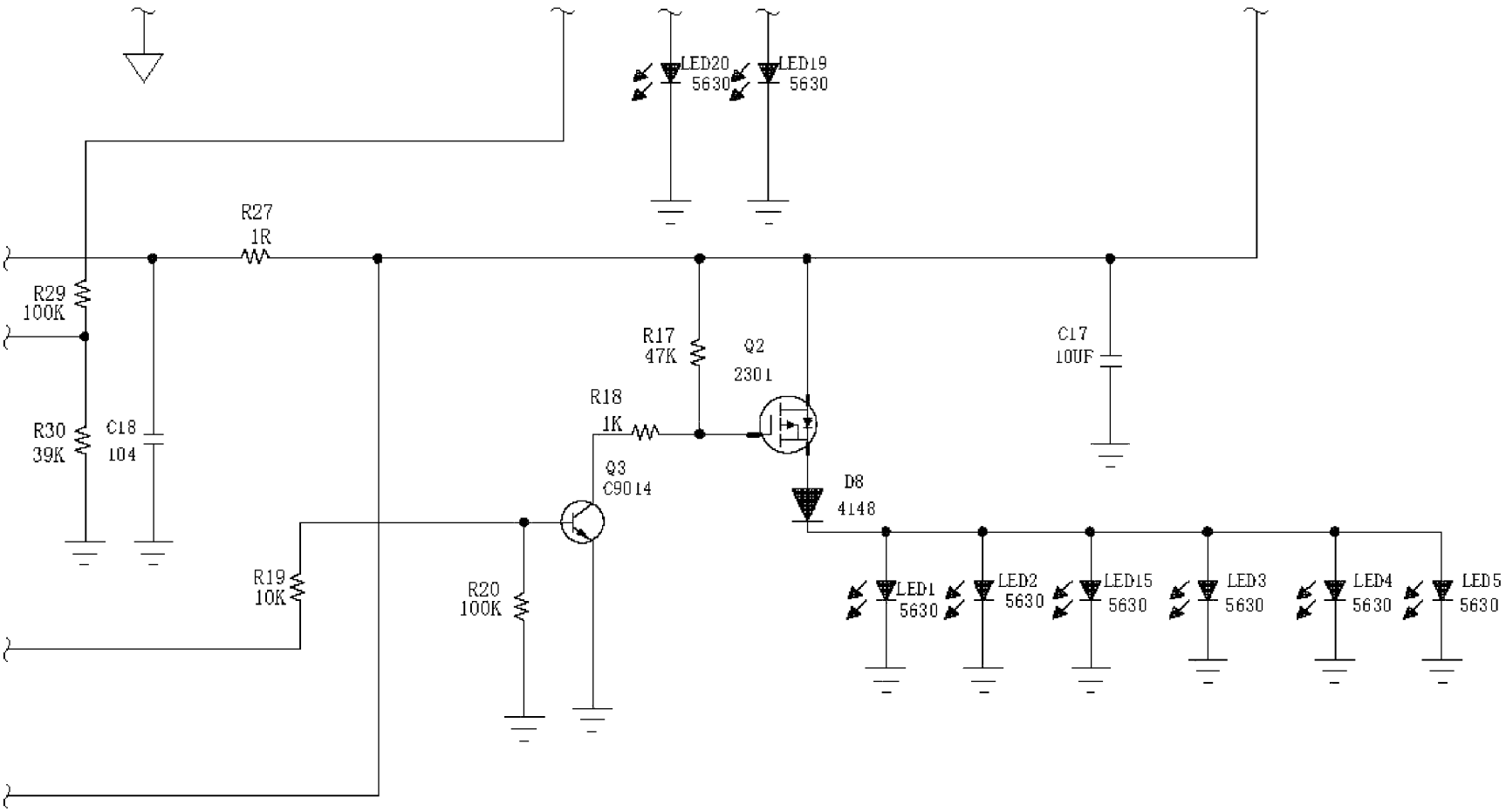
Figure 2:
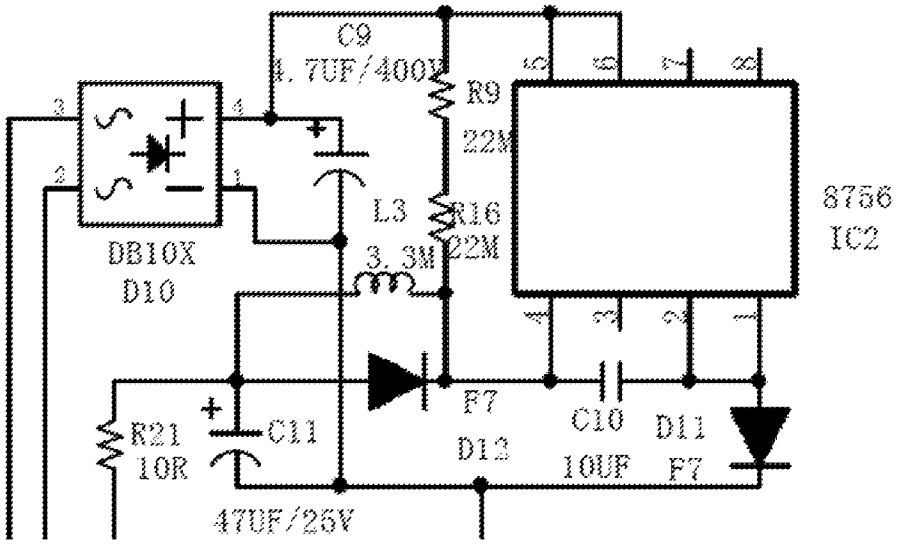
FIG. 2 is an amplified structure diagram of a PWM circuit in FIGS. 1A-1D.
Figure 3:
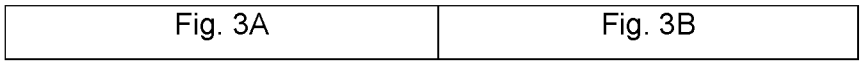
FIG. 3 shows a map of the FIGS. 3A-3B which form an entire schematic.
Figure 3A:
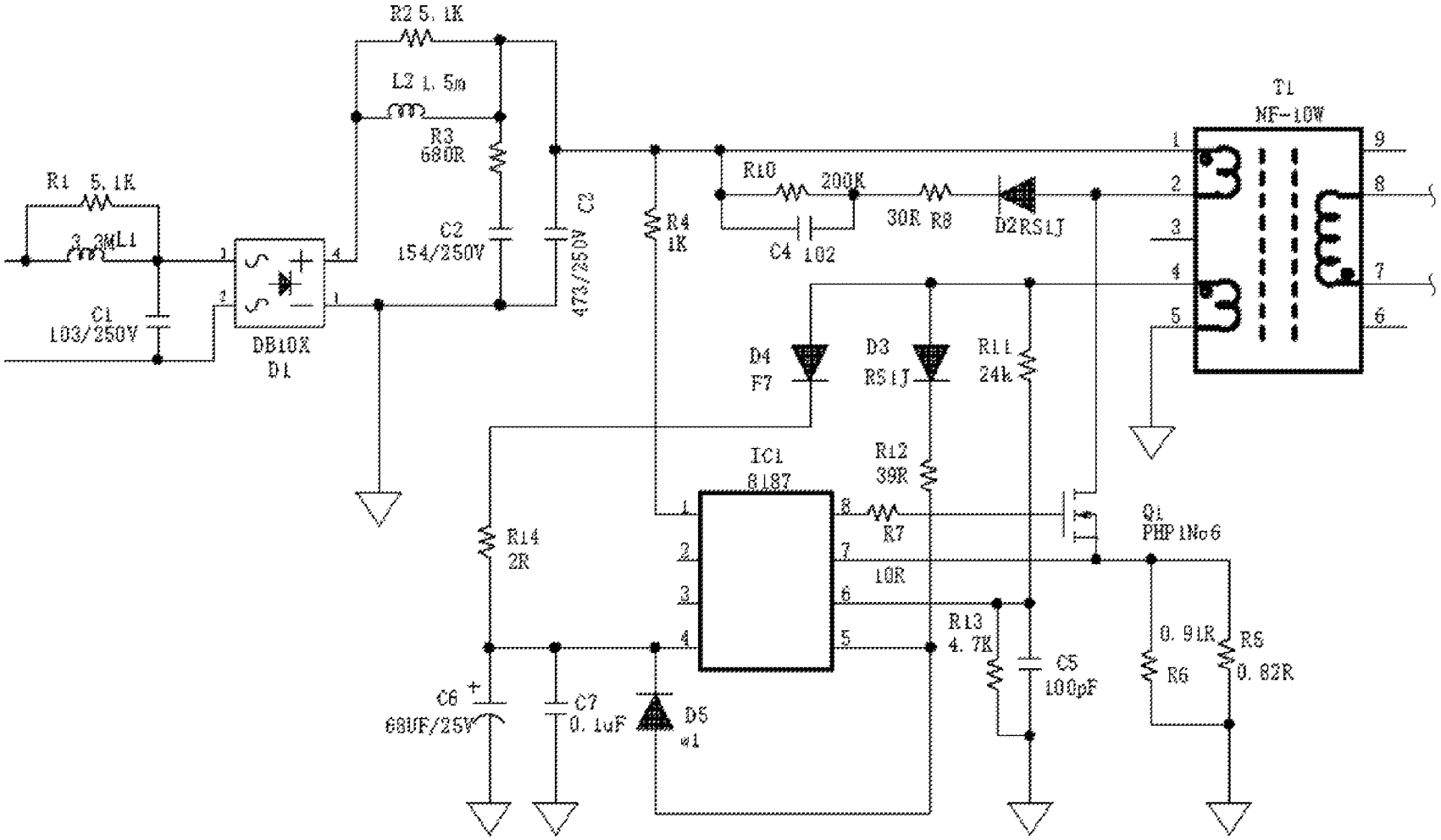
FIGS. 3A and 3B are divided diagrams of an amplified structure of an LED circuit, LED load circuit and storage battery circuit in FIGS. 1A-1D.
Figure 3B:
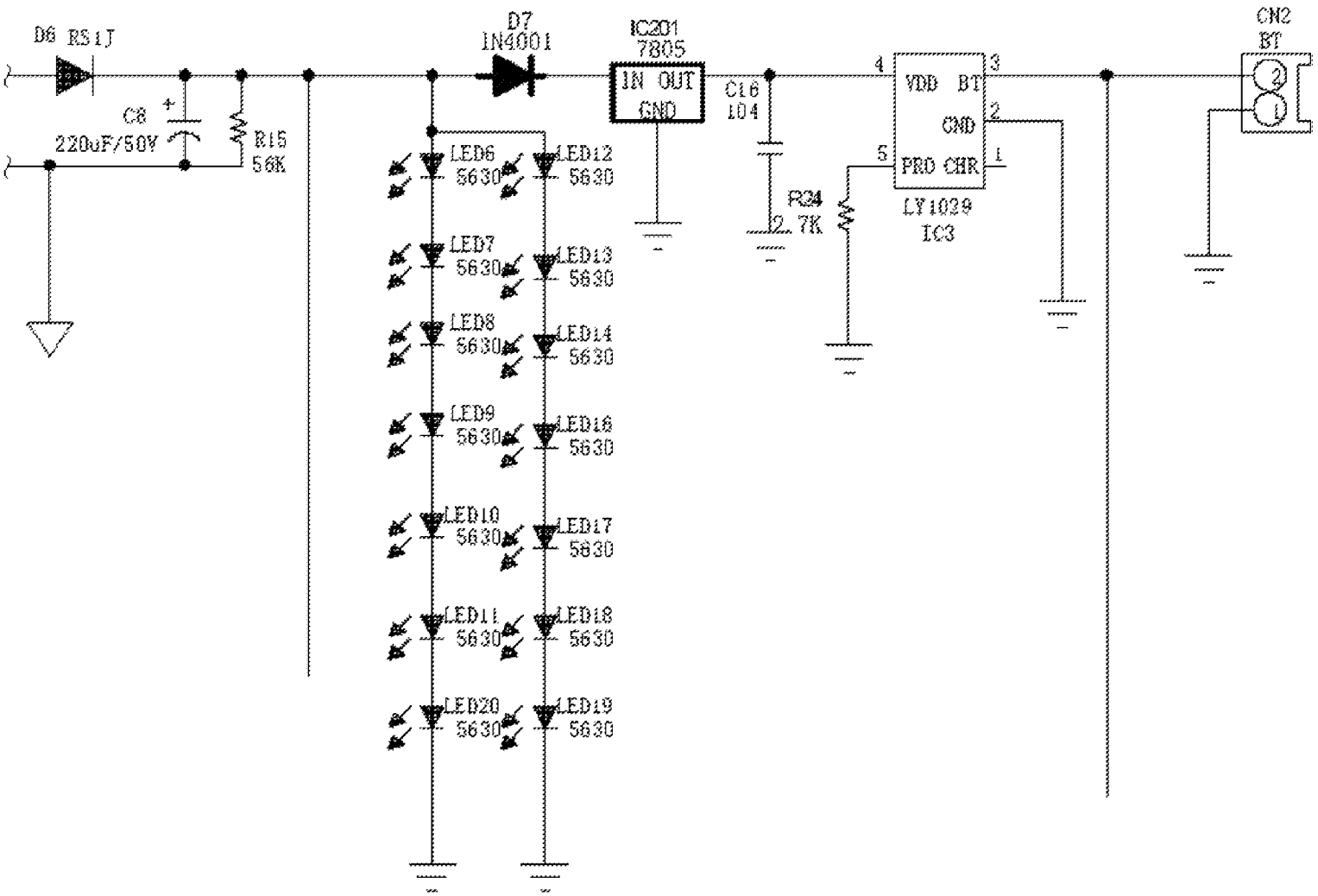
Figure 4:
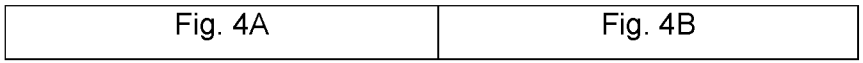
FIG. 4 shows a map of the FIGS. 4A-4B which form an entire schematic.
Figure 4A:
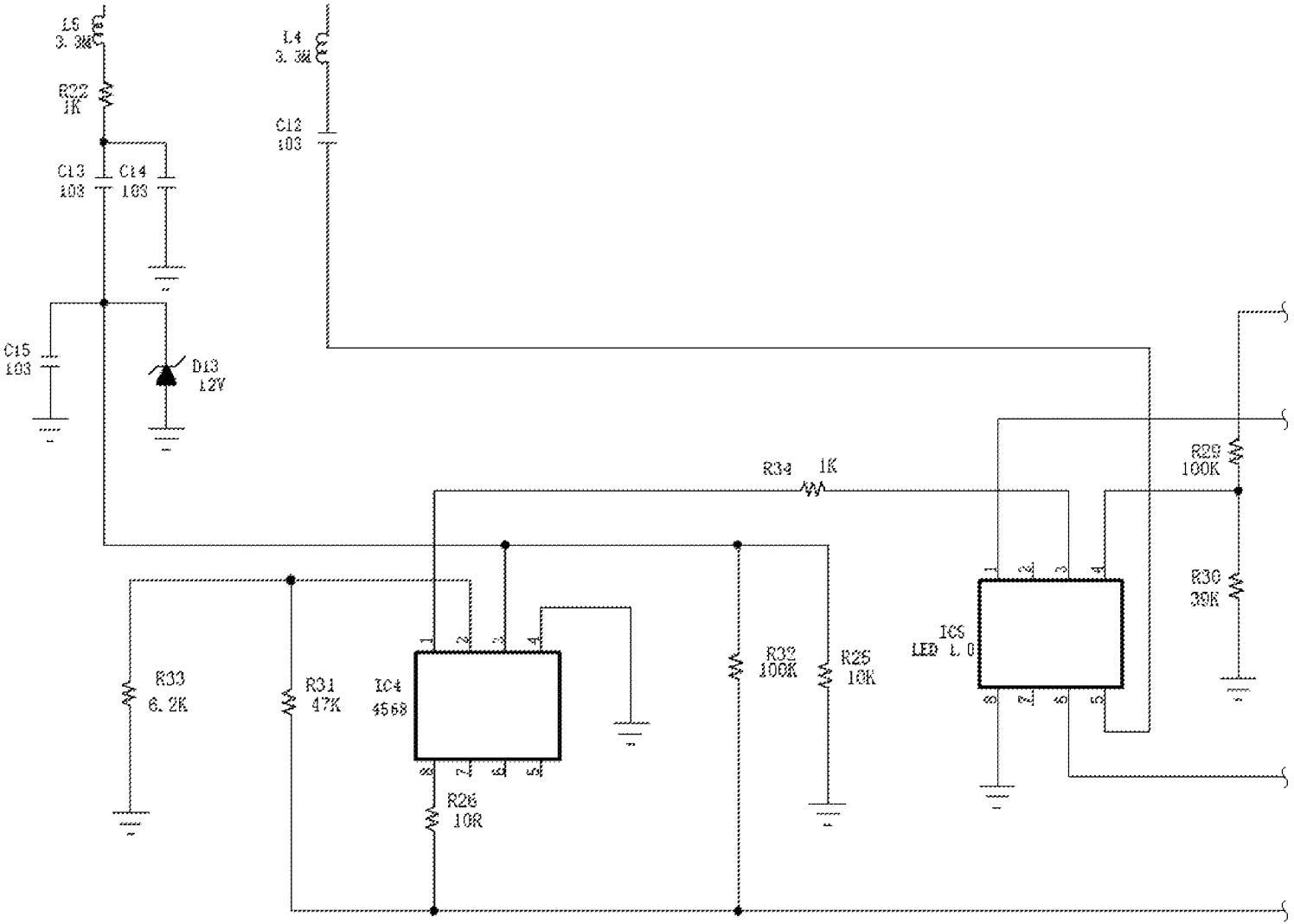
FIGS. 4A and 4B are divided diagrams of an amplified structure of a dual-operational amplification circuit and central processor circuit in FIGS. 1A-1D.
Figure 4B:
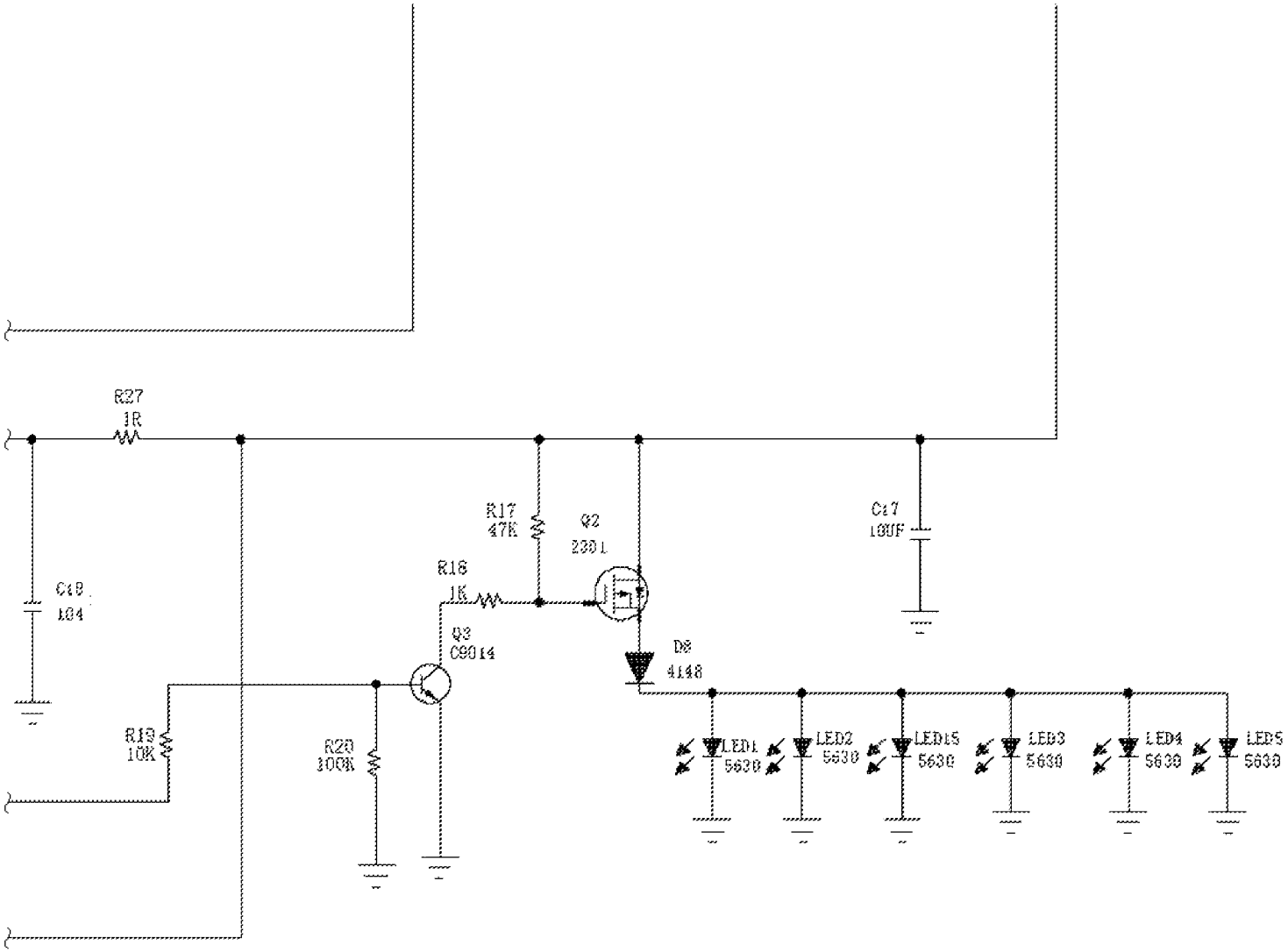

Embodiment: referring to FIG. 1 to FIG. 4B, the embodiment provides an AC dimming and emergency power supply method, which includes the following steps:

(1) a PWM pulse module is arranged, an input end of the PWM pulse module being connected with AC of commercial power;

(2) a relay is arranged at an output end of the PWM pulse module, and the relay is also connected with the commercial power;

(3) an LED illumination module is arranged, an LED driving module being connected between the LED illumination module and the commercial power;

(4) a storage battery module is arranged, the storage battery module including a power stabilization charging module and a storage battery;

(5) a dual-operational amplification module and central processor module which are connected with each other are arranged, the storage battery being connected with the central processor module and supplying power to the central processor module for long;

(6) an emergency illumination LED module connected with the central processor module is arranged;

(7) when there is commercial power, the PWM pulse module controls the relay to switch off dimming AC output by the dual-operational amplification module and an AC signal sent by the central processor module, and at this moment, the AC of the commercial power supplies power to the LED illumination module through the LED driving module and simultaneously charges the storage battery through the voltage stabilization charging module; and (8) when there is no commercial power input, the central processor module outputs and transmits a positive power signal to the relay through the dual-operational amplification module, the relay connects the dimming AC output by the dual-operational amplification module with the AC signal sent by the central processor module, and transmits the positive power signal to the AC, thereby supplying power to a load connected to the AC to implement emergency power supply, and at the same time of emergency power supply, LED AC dimming is implemented through the dual-operational amplification module and the central processor module.

The PWM pulse module includes a chip IC2, a resistor R9, a resistor R16, an inductor L3, a resistor R21, a bridge rectifier D10, a capacitor C9, a capacitor C11, a capacitor C10, a diode D12 and a diode D11, wherein pin 1 of the chip IC2 is connected with pin 2 of the chip IC2, a positive electrode of the diode D11 and one end of the capacitor C10, pin 4 of the chip IC2 is connected with the other end of the capacitor C10, a negative electrode of the diode D12, one end of the inductor L3 and one end of the resistor R16, pin 5 of the chip IC2 is connected with pin 6 of the chip IC2, one end of the resistor R9, pin 4 of the bridge rectifier D10 and a positive electrode of the capacitor C9, the other end of the resistor R9 is connected with the other end of the resistor R16, a negative electrode of the diode D11 is connected with the relay, a negative electrode of the capacitor C11, a negative electrode of the capacitor C9 and pin 1 of the bridge rectifier D10, a positive electrode of the diode D12 is connected with a positive electrode of the capacitor C11, the other end of the inductor L3 and one end of the resistor R12, the other end of the resistor R12 is connected with the relay, and pins 2 and 3 of the bridge rectifier D10 are connected with the commercial power.

The LED driving module includes a resistor R1, an inductor L1, a capacitor C1, a bridge rectifier D1, a resistor R2, an inductor L2, a resistor R3, a capacitor C2, a capacitor C3, a resistor R4, a resistor R10, a capacitor C4, a resistor R8, a diode D2, a transformer T1, a resistor R11, a diode D3, a diode D4, a chip IC1, a resistor R14, a capacitor C6, a capacitor C7, a diode D5, a resistor R12, a resistor R7, a resistor R13, a capacitor C5, a Metal Oxide Semiconductor (MOS) tube Q1, a resistor R6, a resistor R5, a diode D6, a capacitor C8 and a resistor R15, wherein one end of the resistor R1 and one end of the inductor L1 are connected with the commercial power, the other end of the resistor R1 is connected with the other end of the inductor L1, one end of the capacitor C1 and pin 3 of the bridge rectifier, and pin 2 of the bridge rectifier D1 and the other end of the capacitor C1 are connected with the relay; and pin 4 of the bridge rectifier is connected with one end of the resistor R2 and one end of the inductor L2, the other end of the resistor R2 is connected with the other end of the inductor L2, one end of the resistor R3, one end of the capacitor C3, one end of the resistor R4, one end of the resistor R10, one end of the capacitor C4 and pin 1 of the transformer T1, pin 1 of the bridge rectifier, one end of the capacitor C2 and the other end of the capacitor C3 are all grounded, the other end of the resistor R3 is connected with the other end of the capacitor C2, the other end of the resistor R10 is connected with the other end of the capacitor C4 and one end of the resistor R8, the other end of the resistor R8 is connected with a negative electrode of the diode D2, a positive electrode of the diode D2 is connected with pin 2 of the transformer T1 and electrode D of the MOS tube Q1, pin 1 of the chip IC1 is connected with one end of the resistor R4, pin 4 of the chip 101 is connected with a negative electrode of the diode D5, one end of the capacitor C7, a positive electrode of the capacitor C6 and one end of the resistor R14, the other end of the resistor R14 is connected with a negative electrode of the diode D4, a positive electrode of the diode D4 is connected with a positive electrode of the diode D3, one end of the resistor R11 and pin 4 of the transformer T1, pin 5 of the chip 101 is connected with a positive electrode of the diode D5 and one end of the resistor R12, the other end of the resistor R12 is connected with a negative electrode of the diode D5, pin 6 of the chip 101 is connected with one end of the resistor R13, the other end of the resistor R11 and one end of the capacitor C5, pin 7 of the chip 101 is connected with electrode S of the MOS tube Q1, one end of the resistor R6 and one end of the resistor R5, pin 8 of the chip 101 is connected with one end of the resistor R7, the other end of the resistor R7 is connected with electrode G of the MOS tube Q1, the other end of the resistor R13, the other end of the capacitor C5, the other end of the resistor R6, the other end of the resistor R5, pin 5 of the transformer T1, a negative electrode of the capacitor C6 and the other end of the capacitor C7 are all grounded, pin 8 of the transformer T1 is connected with a positive electrode of the diode D6, a negative electrode of the diode D6 is connected with a positive electrode of the capacitor C8, one end of the resistor R15 and an LED load, and pin 7 of the transformer T1, a negative electrode of the capacitor C8 and the other end of the resistor R15 are all grounded.

The dual-operational amplification module includes an inductor L5, a resistor R22, a capacitor C13, a capacitor C14, a capacitor C15, a diode D13, a resistor R33, a resistor R31, a resistor R26, a chip 104, a resistor R32 and a resistor R25, wherein one end of the inductor L5 is connected with the relay, the other end of the inductor L5 is connected with one end of the resistor R22, the other end of the resistor R22 is connected with one end of the capacitor C13 and one end of the capacitor C14, the other end of the capacitor C13 is connected with one end of the capacitor C15, a positive electrode of the diode D13, pin 3 of the chip IC4, one end of the resistor R32 and one end of the resistor R25, pin 1 of the chip 104 is connected with the central processor module, pin 2 of the chip 104 is connected with one end of the resistor R33 and one end of the resistor R31, pin 8 of the chip 104 is connected with one end of the resistor R26, the other end of the resistor R26 is connected with the other end of the resistor R31 and the other end of the resistor R32, and the other end of the resistor 33, the other end of the resistor R25 and pin 4 of the chip 104 are all grounded.

The central processor module includes a chip 105, a resistor R34, a resistor R26, a resistor R30, a capacitor C18, a resistor R27 and a resistor R19, wherein pin 1 of the chip 105 is connected with one end of the resistor R27 and one end of the capacitor C18, pin 3 of the chip 105 is connected with one end of the resistor R34, pin 4 of the chip 105 is connected with one end of the resistor R29 and one end of the resistor R30, pin 5 of the chip IC5 is connected with the relay, pin 6 of the chip 105 is connected with one end of the resistor R19, and pin 8 of the chip IC5, the other end of the resistor R30 and the other end of the capacitor C18 are all grounded.

The emergency illumination LED module includes a triode amplification circuit, an MOS tube amplification circuit and an emergency LED lamp load.

A device for implementing the abovementioned AC dimming and emergency power supply method includes a PWM pulse circuit, an input end of the PWM pulse circuit being connected with AC of commercial power, an output end of the PWM pulse circuit being connected with a relay and the relay being also connected with the commercial power; an LED illumination circuit, an LED driving circuit being connected between the LED illumination circuit and the commercial power; a storage battery circuit, the storage battery circuit including a voltage stabilization charging circuit and a storage battery; and the device further including a dual-operational amplification circuit and central processor circuit which are connected with each other, the storage battery being connected with the central processor circuit and supplying power to the central processor circuit, and the central processor circuit being also connected with an emergency illumination LED circuit.

The above is the preferred feasible embodiment of the invention and not intended to limit the scope of patent of the invention. Therefore, any method step and equivalent structure transformations made by virtue of the contents of the specification of the invention shall fall within the scope of protection of the invention.

What is claimed is:

1. An Alternating Current (AC) dimming and emergency power supply method, comprising the following steps that:

(1) a Pulse Width Modulation (PWM) pulse module is arranged, an input end of the PWM pulse module being connected with AC of commercial power;

(2) a relay is arranged at an output end of the PWM pulse module, and the relay is also connected with the commercial power;

(3) a Light-Emitting Diode (LED) illumination module is arranged, an LED driving module being connected between the LED illumination module and the commercial power;

(4) a storage battery module is arranged, the storage battery module comprising a power stabilization charging module and a storage battery;

(5) a dual-operational amplification module and central processor module which are connected with each other are arranged, the storage battery being connected with the central processor module and supplying power to the central processor module for long;

(6) an emergency illumination LED module connected with the central processor module is arranged;

(7) when there is commercial power, the PWM pulse module controls the relay to switch off dimming AC output by the dual-operational amplification module and an AC signal sent by the central processor module, and at this moment, the AC of the commercial power supplies power to the LED illumination module through the LED driving module and simultaneously charges the storage battery through the voltage stabilization charging module; and (8) when there is no commercial power input, the central processor module outputs and transmits a positive power signal to the relay through the dual-operational amplification module, the relay connects the dimming AC output by the dual-operational amplification module with the AC signal sent by the central processor module, and transmits the positive power signal to the AC, thereby supplying power to a load connected to the AC to implement emergency power supply, and at the same time of emergency power supply, LED AC dimming is implemented through the dual-operational amplification module and the central processor module.

2. The AC dimming and emergency power supply method according to claim 1, wherein the PWM pulse module comprises a chip IC2, a resistor R9, a resistor R16, an inductor L3, a resistor R21, a bridge rectifier D10, a capacitor C9, a capacitor C11, a capacitor C10, a diode D12 and a diode D11, wherein pin 1 of the chip IC2 is connected with pin 2 of the chip IC2, a positive electrode of the diode D11 and one end of the capacitor C10, pin 4 of the chip IC2 is connected with the other end of the capacitor C10, a negative electrode of the diode D12, one end of the inductor L3 and one end of the resistor R16, pin 5 of the chip IC2 is connected with pin 6 of the chip IC2, one end of the resistor R9, pin 4 of the bridge rectifier D10 and a positive electrode of the capacitor C9, the other end of the resistor R9 is connected with the other end of the resistor R16, a negative electrode of the diode D11 is connected with the relay, a negative electrode of the capacitor C11, a negative electrode of the capacitor C9 and pin 1 of the bridge rectifier D10, a positive electrode of the diode D12 is connected with a positive electrode of the capacitor C11, the other end of the inductor L3 and one end of the resistor R12, the other end of the resistor R12 is connected with the relay, and pins 2 and 3 of the bridge rectifier D10 are connected with the commercial power.

3. The AC dimming and emergency power supply method according to claim 1, wherein the LED driving module comprises a resistor R1, an inductor L1, a capacitor C1, a bridge rectifier D1, a resistor R2, an inductor L2, a resistor R3, a capacitor C2, a capacitor C3, a resistor R4, a resistor R10, a capacitor C4, a resistor R8, a diode D2, a transformer T1, a resistor R11, a diode D3, a diode D4, a chip IC1, a resistor R14, a capacitor C6, a capacitor C7, a diode D5, a resistor R12, a resistor R7, a resistor R13, a capacitor C5, a Metal Oxide Semiconductor (MOS) tube Q1, a resistor R6, a resistor R5, a diode D6, a capacitor C8 and a resistor R15, wherein one end of the resistor R1 and one end of the inductor L1 are connected with the commercial power, the other end of the resistor R1 is connected with the other end of the inductor L1, one end of the capacitor C1 and pin 3 of the bridge rectifier, and pin 2 of the bridge rectifier D1 and the other end of the capacitor C1 are connected with the relay; and pin 4 of the bridge rectifier is connected with one end of the resistor R2 and one end of the inductor L2, the other end of the resistor R2 is connected with the other end of the inductor L2, one end of the resistor R3, one end of the capacitor C3, one end of the resistor R4, one end of the resistor R10, one end of the capacitor C4 and pin 1 of the transformer T1, pin 1 of the bridge rectifier, one end of the capacitor C2 and the other end of the capacitor C3 are all grounded, the other end of the resistor R3 is connected with the other end of the capacitor C2, the other end of the resistor R10 is connected with the other end of the capacitor C4 and one end of the resistor R8, the other end of the resistor R8 is connected with a negative electrode of the diode D2, a positive electrode of the diode D2 is connected with pin 2 of the transformer T1 and electrode D of the MOS tube Q1, pin 1 of the chip 101 is connected with one end of the resistor R4, pin 4 of the chip 101 is connected with a negative electrode of the diode D5, one end of the capacitor C7, a positive electrode of the capacitor C6 and one end of the resistor R14, the other end of the resistor R14 is connected with a negative electrode of the diode D4, a positive electrode of the diode D4 is connected with a positive electrode of the diode D3, one end of the resistor R11 and pin 4 of the transformer T1, pin 5 of the chip 101 is connected with a positive electrode of the diode D5 and one end of the resistor R12, the other end of the resistor R12 is connected with a negative electrode of the diode D5, pin 6 of the chip 101 is connected with one end of the resistor R13, the other end of the resistor R11 and one end of the capacitor C5, pin 7 of the chip 101 is connected with electrode S of the MOS tube Q1, one end of the resistor R6 and one end of the resistor R5, pin 8 of the chip 101 is connected with one end of the resistor R7, the other end of the resistor R7 is connected with electrode G of the MOS tube Q1, the other end of the resistor R13, the other end of the capacitor C5, the other end of the resistor R6, the other end of the resistor R5, pin 5 of the transformer T1, a negative electrode of the capacitor C6 and the other end of the capacitor C7 are all grounded, pin 8 of the transformer T1 is connected with a positive electrode of the diode D6, a negative electrode of the diode D6 is connected with a positive electrode of the capacitor C8, one end of the resistor R15 and an LED load, and pin 7 of the transformer T1, a negative electrode of the capacitor C8 and the other end of the resistor R15 are all grounded.

4. The AC dimming and emergency power supply method according to claim 1, wherein the dual-operational amplification module comprises an inductor L5, a resistor R22, a capacitor C13, a capacitor C14, a capacitor C15, a diode D13, a resistor R33, a resistor R31, a resistor R26, a chip 104, a resistor R32 and a resistor R25, wherein one end of the inductor L5 is connected with the relay, the other end of the inductor L5 is connected with one end of the resistor R22, the other end of the resistor R22 is connected with one end of the capacitor C13 and one end of the capacitor C14, the other end of the capacitor C13 is connected with one end of the capacitor C15, a positive electrode of the diode D13, pin 3 of the chip 104, one end of the resistor R32 and one end of the resistor R25, pin 1 of the chip 104 is connected with the central processor module, pin 2 of the chip 104 is connected with one end of the resistor R33 and one end of the resistor R31, pin 8 of the chip 104 is connected with one end of the resistor R26, the other end of the resistor R26 is connected with the other end of the resistor R31 and the other end of the resistor R32, and the other end of the resistor 33, the other end of the resistor R25 and pin 4 of the chip 104 are all grounded.

5. The AC dimming and emergency power supply method according to claim 1, wherein the central processor module comprises a chip 105, a resistor R34, a resistor R26, a resistor R30, a capacitor C18, a resistor R27 and a resistor R19, wherein pin 1 of the chip 105 is connected with one end of the resistor R27 and one end of the capacitor C18, pin 3 of the chip 105 is connected with one end of the resistor R34, pin 4 of the chip 105 is connected with one end of the resistor R29 and one end of the resistor R30, pin 5 of the chip IC5 is connected with the relay, pin 6 of the chip 105 is connected with one end of the resistor R19, and pin 8 of the chip IC5, the other end of the resistor R30 and the other end of the capacitor C18 are all grounded.

6. The AC dimming and emergency power supply method according to claim 1, wherein the emergency illumination LED module comprises a triode amplification circuit, an MOS tube amplification circuit and an emergency LED lamp load.

7. A device for implementing the Alternating Current (AC) dimming and emergency power supply method, comprising a Pulse Width Modulation (PWM) pulse circuit, an input end of the PWM pulse circuit being connected with AC of commercial power, an output end of the PWM pulse circuit being connected with a relay and the relay being also connected with the commercial power; a Light-Emitting Diode (LED) illumination circuit, an LED driving circuit being connected between the LED illumination circuit and the commercial power; a storage battery circuit, the storage battery circuit comprising a voltage stabilization charging circuit and a storage battery; and the device further comprising a dual-operational amplification circuit and central processor circuit which are connected with each other, the storage battery being connected with the central processor circuit and supplying power to the central processor circuit, and the central processor circuit being also connected with an emergency illumination LED circuit.

* * * * *